US011026518B2

(12) United States Patent
Marino et al.

(10) Patent No.: US 11,026,518 B2
(45) Date of Patent: Jun. 8, 2021

(54) MATTRESS CARRIER

(71) Applicant: TUFT & NEEDLE, LLC, Phoenix, AZ (US)

(72) Inventors: John Thomas Marino, Phoenix, AZ (US); Katie Ann Anderson, Phoenix, AZ (US)

(73) Assignee: TUFT & NEEDLE, LLC, Phoenix, AZ (US)

( * ) Notice: Subject to any disclaimer, the term of this patent is extended or adjusted under 35 U.S.C. 154(b) by 247 days.

(21) Appl. No.: 16/037,833

(22) Filed: Jul. 17, 2018

(65) Prior Publication Data

US 2019/0021515 A1 Jan. 24, 2019

Related U.S. Application Data

(60) Provisional application No. 62/533,915, filed on Jul. 18, 2017.

(51) Int. Cl.

| | |
|---|---|
| ***A47C 31/10*** | (2006.01) |
| ***A45C 13/10*** | (2006.01) |
| ***A45C 3/00*** | (2006.01) |
| ***A45C 13/30*** | (2006.01) |
| ***A45C 13/26*** | (2006.01) |
| ***A45C 13/00*** | (2006.01) |

(52) U.S. Cl.

CPC ..... *A47C 31/105* (2013.01); *A45C 3/00* (2013.01); *A45C 13/002* (2013.01); *A45C 13/1092* (2013.01); *A45C 13/26* (2013.01); *A45C 13/30* (2013.01)

(58) Field of Classification Search

CPC . A47C 31/105; A47C 31/002; A47C 31/1092; A47C 31/08; A47C 31/30; A45C 3/00; A45C 13/30; A45C 13/26

USPC ..... 5/537

See application file for complete search history.

(56) References Cited

U.S. PATENT DOCUMENTS

| | | | | |
|---|---|---|---|---|
| 4,521,045 | A * | 6/1985 | Hart | A47C 27/00 294/149 |
| 5,720,057 | A * | 2/1998 | Duncan | A47C 27/001 5/420 |
| 9,107,519 | B2 * | 8/2015 | Clark | A47G 9/08 |
| 2004/0045091 | A1 * | 3/2004 | Ogle | A47C 27/001 5/722 |
| 2010/0299836 | A1 * | 12/2010 | Tanaka | A47C 31/08 5/626 |

(Continued)

*Primary Examiner* — Eric J Kurilla
*Assistant Examiner* — James T Coble
(74) *Attorney, Agent, or Firm* — Arent Fox LLP

(57) ABSTRACT

A device for transporting and protecting a mattress via a cover containing straps and buckles, which allow the mattress to optionally be secured in a folded position. The cover may be made of a durable, water-impermeable fabric or other material, such as Cordura®, which both protects the mattress and its surroundings from damage. The cover may include, an end opening, such as a zipper, which allows the cover to slide over the mattress and then be enclosed therein. A strap or straps may be attached to the mattress, and the mattress may be folded in half and buckled in order for it to be transported. An additional strap and buckle may be located in the center of the cover to add additional support if necessary. The cover further may contain eight handles that may be used to pick up and transport the mattress.

15 Claims, 11 Drawing Sheets

(56) References Cited

U.S. PATENT DOCUMENTS

2015/0296995 A1* 10/2015 Krim ..... A47C 31/08
5/724

* cited by examiner

MATTRESS CARRIER

The present application claims the benefit of priority of applicant's U.S. Provisional Application No. 62/533,915 filed on Jul. 18, 2017, titled MATTRESS CARRIER, the entire contents of which are incorporated herein by reference.

FIELD OF THE TECHNOLOGY

Aspects of the present disclosure relate to a device to transport mattresses of varying sizes.

BACKGROUND

There are often times when it is necessary to move a mattress from one location another, without damaging either the mattress or the surrounding area. For example, there may be a need to move a mattress from one house to another, or to ship a mattress. In these scenarios it can be difficult to carry the mattress and easy to cause damage to the mattress itself or the walls and surrounding objects.

SUMMARY

The above mentioned problems, as well as others, present a need for a better way to transport mattresses, and aspects of this disclosure address that unmet need. Aspects of the present disclosure include a mattress cover, which may selectively be used to cover a mattress and for other uses, such as transport of the mattress. In use for transport, for example, the mattress may be folded in half, and straps, with buckles, or other attachment devices, may be attached to the cover and used to maintain the mattress in a folded position. The cover may optionally further include one or more handles, which, once the mattress is folded and secured, for example, may be used to lift and transport the mattress.

Additional advantages and novel features of these aspects will be set forth in part in the description that follows, and in part will become more apparent to those skilled in the art upon examination of the following or upon learning by practice of the disclosure.

DETAILED DESCRIPTION

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details.

Aspects of the present disclosure relate to a carrier for a mattress that is usable as a protective cover, which also allows the enclosed mattress to be easier to transport. In some variations the cover may be utilized with a mattress that may be folded, such as a foam mattress.

Aspects of the present disclosure include utilization of any of a variety of durable, water impermeable materials, such as Cordura®, made by Texland & Nexko Co., Ltd., of Sunnam-si, Korea, or a similar fabric, for example, as a material for the body of the cover (the material also interchangeably being referred to herein as the "covering material"), to encase the mattress. A material having qualities like Cordura® may be utilized, for example, as it is a very durable material, more so than nylon and polyester, and is 100% water proof. Cordura® is also resistant to tears, which may make it a valuable material in situations such as moving a mattress, where it may be easy to cut or tear the fabric of the cover and/or the mattress.

In one example implementation, the cover fully encases the mattress and is able to receive the mattress via an opening at one end of the cover. The opening may be closably secured using a zipper or other method and/or features (the closably securing device also interchangeably being referred to herein as the "closure device"). For example, the end may be closed via buttons, buckles, Velcro® (made by Velcro Companies located in Manchester N.H.), one or more straps or end ties, or alternatively, the end may have an envelope type fitting, for example, similar to some pillow covers.

Figure 2:
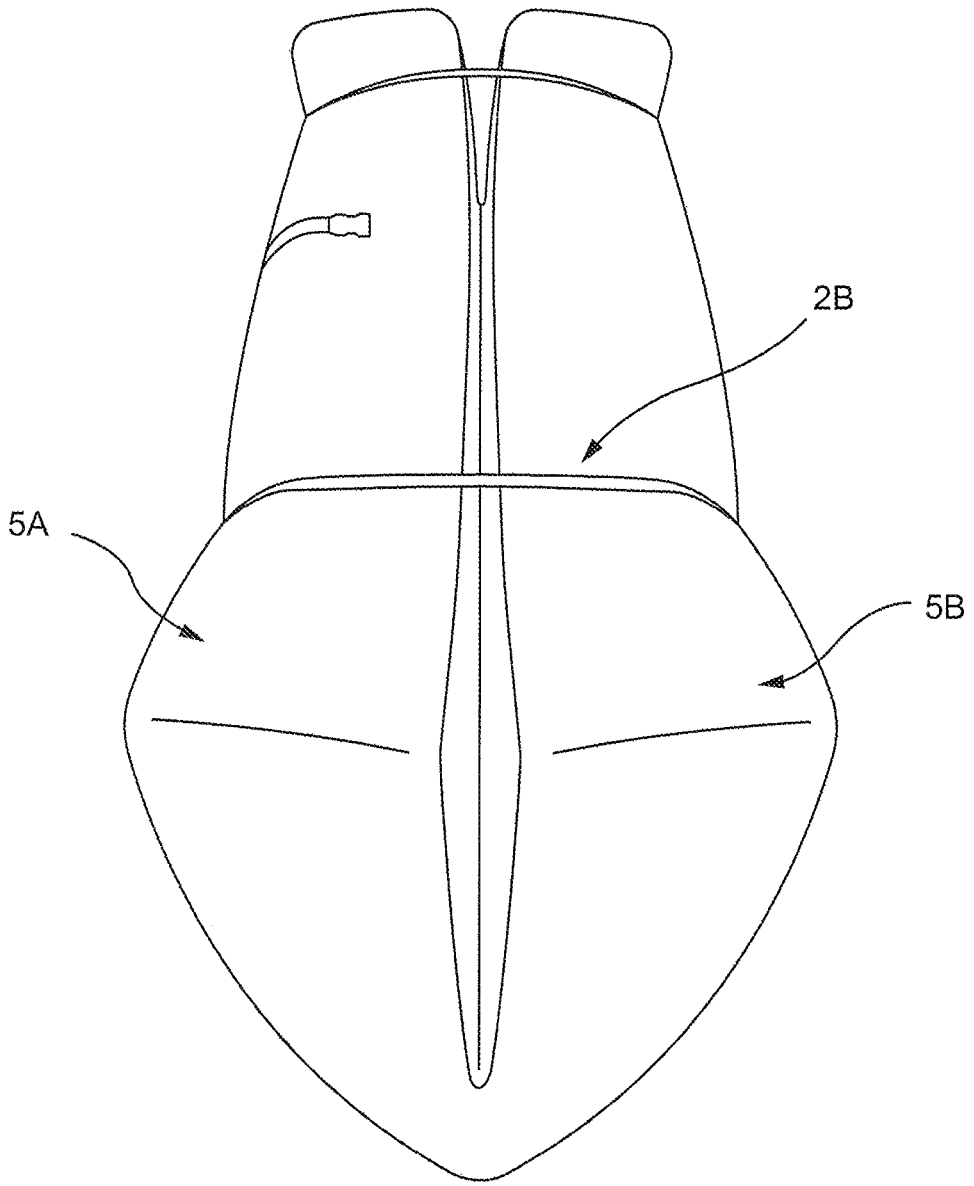
FIG. 2 shows a top view of the encased mattress of FIG. 1, including a vie an enclosing zipper.

FIG. 2 shows where the zipper is connected along one end of the mattress, extending through the points 5A and 5B. The zipper may be configured such that the mattress is slidably receivable within the carrier. This configuration may allow the mattress to easily fit into the carrier with very little resistance, such that the carrier may be quickly and easily enclosed and secured.

Figure 1:
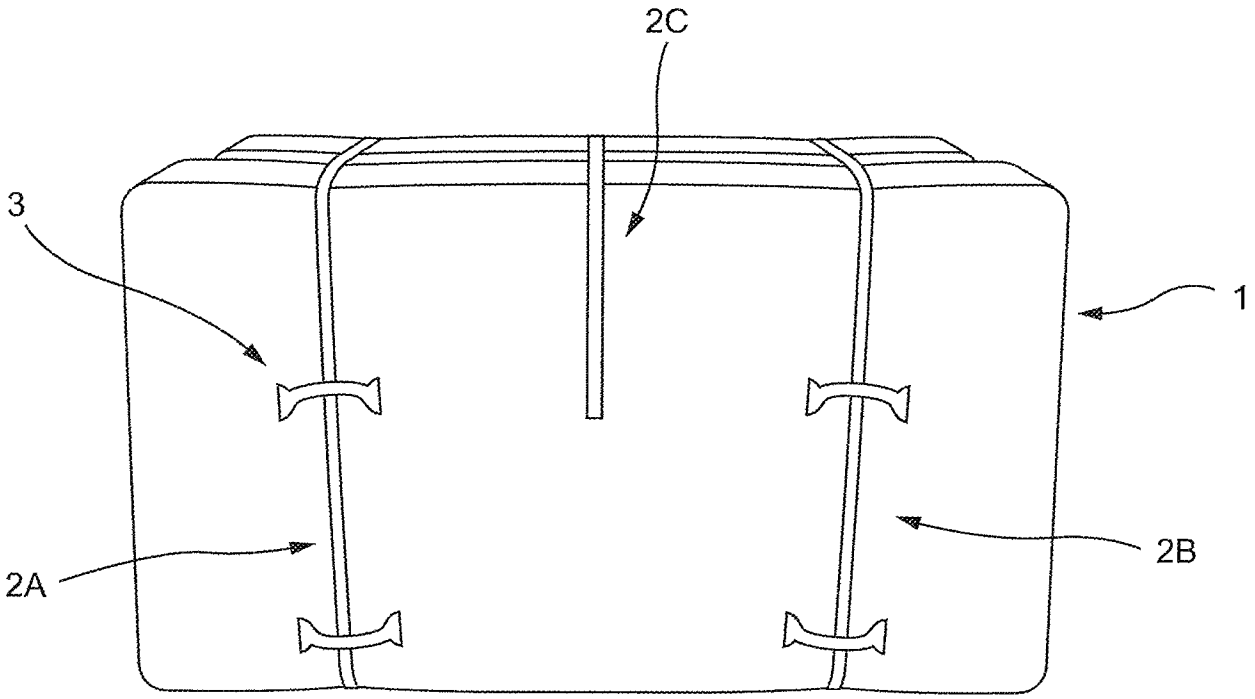
FIG. 1 shows an example mattress encased in a folded position with cover, straps, and handles, in accordance with aspects of the present disclosure.

As shown in FIG. 1, a number of components may work together for use of the carrier. One component is the body of the cover 1, comprising covering material (the body of the cover also interchangeably being referred to herein as the "cover" and/or the "covering material"). The cover 1 may have about the same cross-sectional area size as the mattress to be covered. The cover 1 may fit slightly loosely over a mattress so that the mattress may be easily received into the cover 1, and such that the cover 1 is not too tight so as to prevent the cover 1 and the enclosed mattress together to be easily folded. In the example shown in FIG. 1, the cover 1 comprises a durable, water-impermeable fabric, which is resistant to most external conditions.

Figure 3:
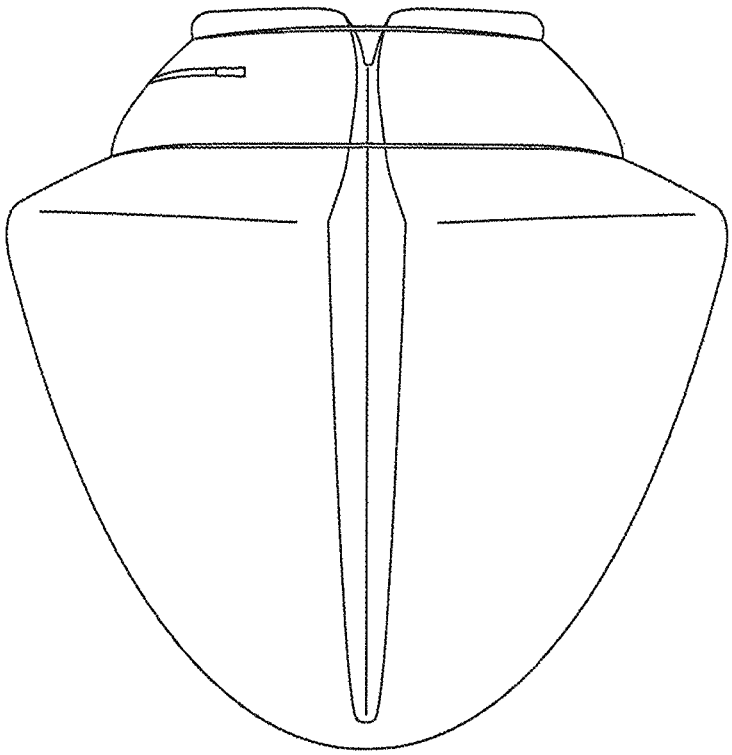
FIG. 3 shows a side view of the encased mattress of FIG. 1.

Also shown in FIGS. 1-3 are straps 2A and 2B. In the example implementation of FIGS. 1-3, two straps 2A and 2B are shown as connected to the carrier along one side (see also example layout pattern for cover manufacturing in FIG. 9). As shown in FIGS. 1-3, both straps 2A and 2B are connected to the cover 1 approximately equidistant from the center of the cover 1 (e.g., relative to approximately where optional support strap 2C is shown), as shown in FIG. 1. Once the mattress within the cover 1 is folded, the straps 2A, 2B may be coupled at their ends, for example, to secure the folded mattress within the cover 1. The straps 2A, 2B may comprise a strong durable material such the mattress does not easily unfold unless the straps 2A, 2B are disengaged.

Figure 7:
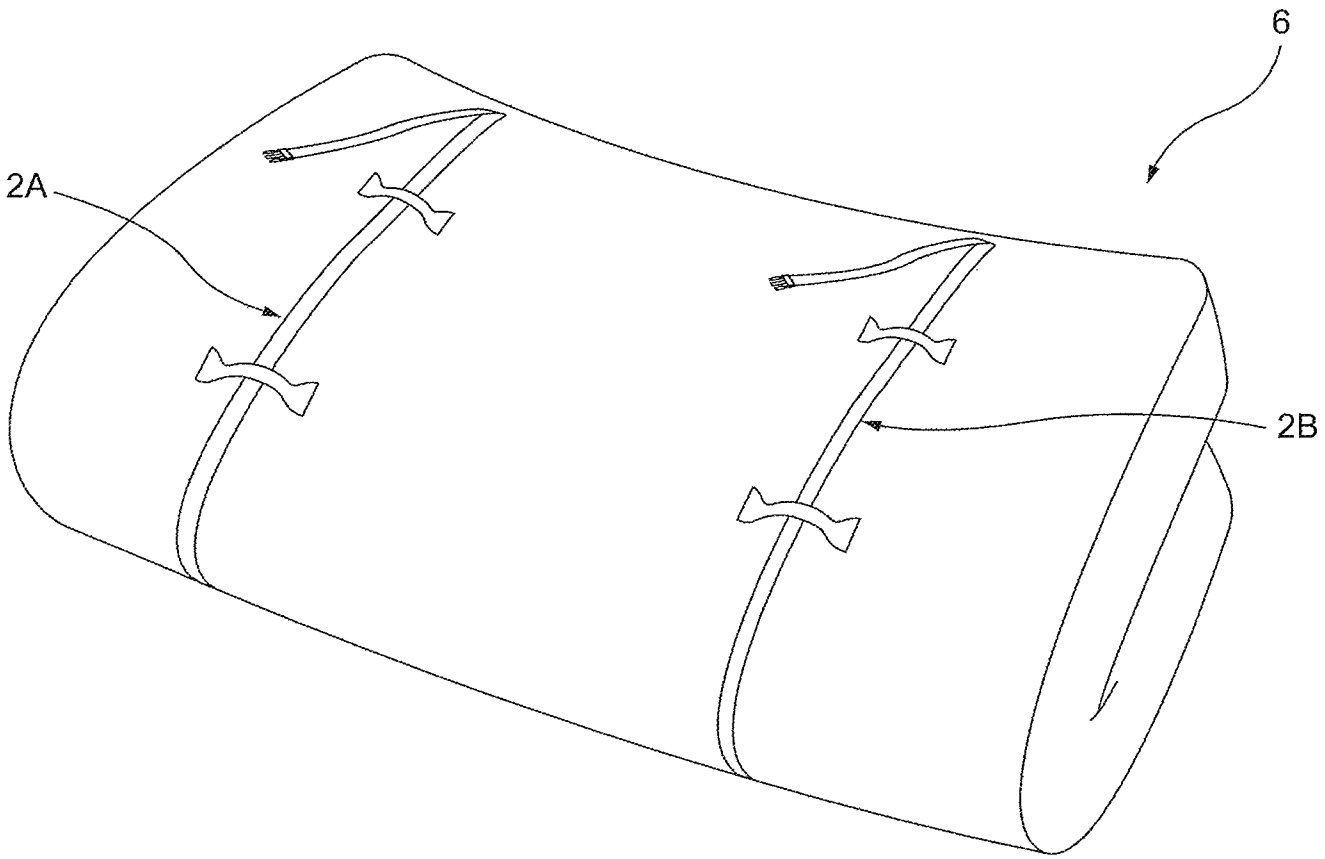
FIG. 7 shows a view of the mattress of FIG. 1, enclosed with the cover being folded and secured.

The straps 2A, 2B may be adjustable in length in order to allow the enclosed mattress to be tightly compressed for transportation using minimal space. The straps 2A, 2B may be oriented and securable about one or more edges of the mattress. For example, the straps 2A, 2B may extend about an edge or edges of an enclosed mattress to secure it in a folded position. As shown in the example implementation of FIG. 7, the ends of straps 2A, 2B may be attached to one another, for example, about edge 6 of a folded mattress within the cover 1. An extra strap 2C (also interchangeably referred to herein as a "support strap") may also be provided so as to, cross approximately the middle of the mattress, to thereby provide extra support, for example, for mattresses that may be more difficult to fold or hold in a position. In the example of FIG. 7, the straps 2A, 2B may comprise nylon webbing and may be connected using plastic buckles or other connection devices. This approach provides a simple method of fastening the folded mattress; however, a number of other materials and methods may also be used to accomplish this result.

Another component of the carrier may include one or more handles 3, as shown FIGS. 1-8. In the example shown in FIGS. 1-8, eight handles are used on the mattress carrier, although any suitable number of handles may be used. Four handles 3 are visible in FIG. 1. The other four are laid out in a similar manner but on the opposite side of the mattress carrier when in the folded position (see, e.g., FIG. 5 for a view of all eight handles 3 prior to folding of the mattress within the cover). The handles 3 may be woven into the fabric of the carrier or otherwise attached in a manner such that they will not easily become detached. The handles 3, similarly to the straps 2A, 2B, may comprise webbed nylon. However, a number of other suitably sturdy and durable materials may also be used.

Figure 4:
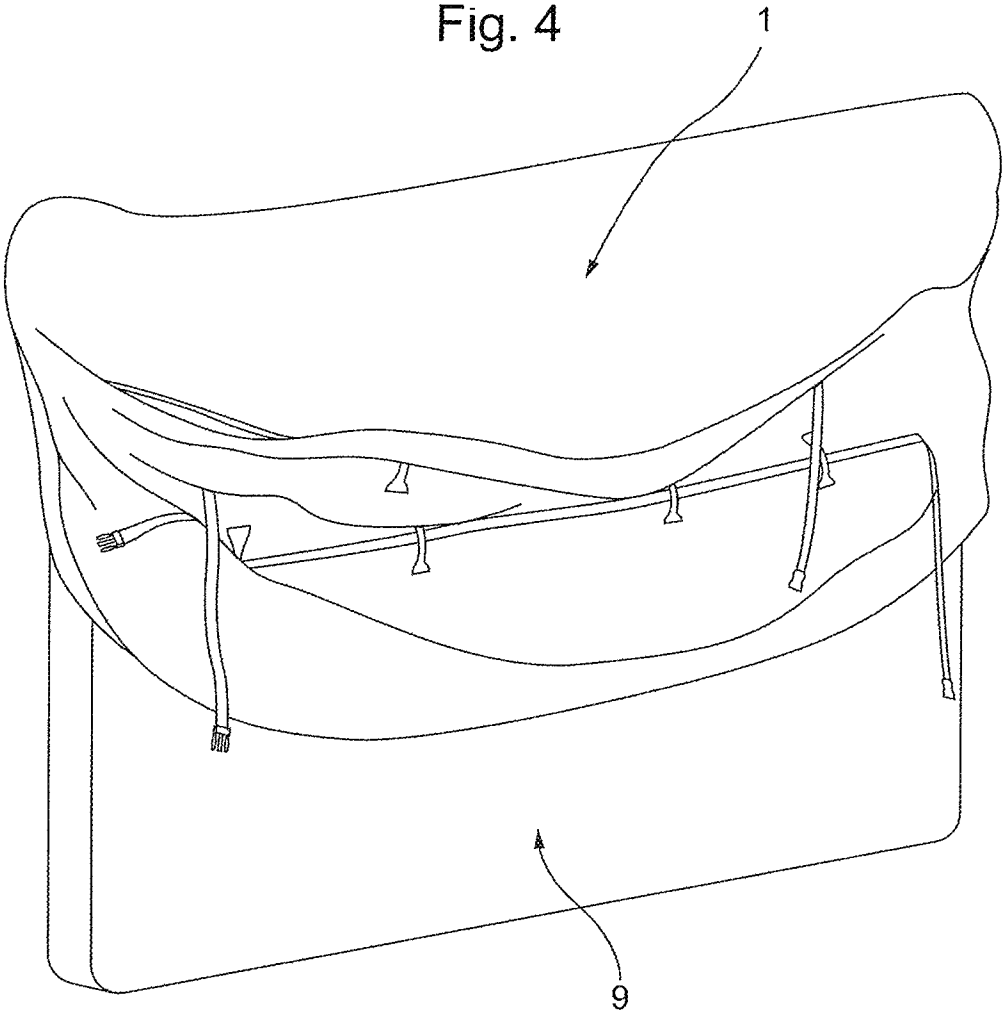
FIG. 4 shows a view of the cover being slid onto the mattress of FIG. 1.
Figure 5:
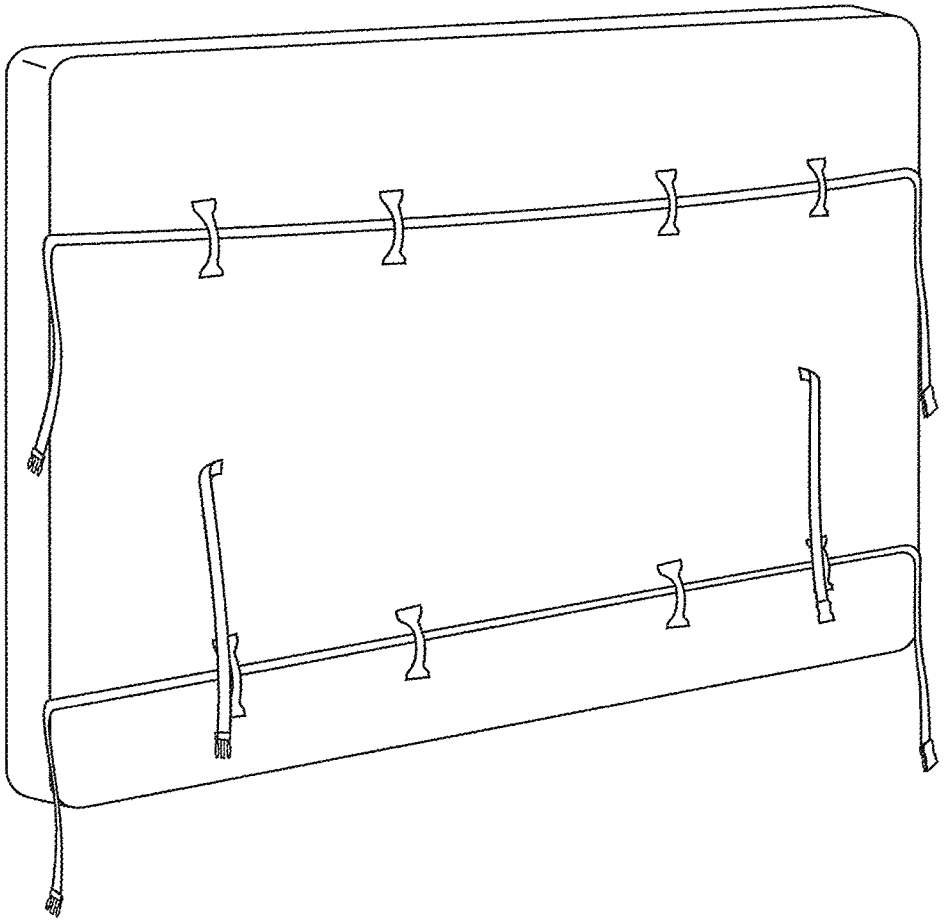
FIG. 5 shows a view of the cover of FIG. 1 after having been put onto the mattress.
Figure 10:
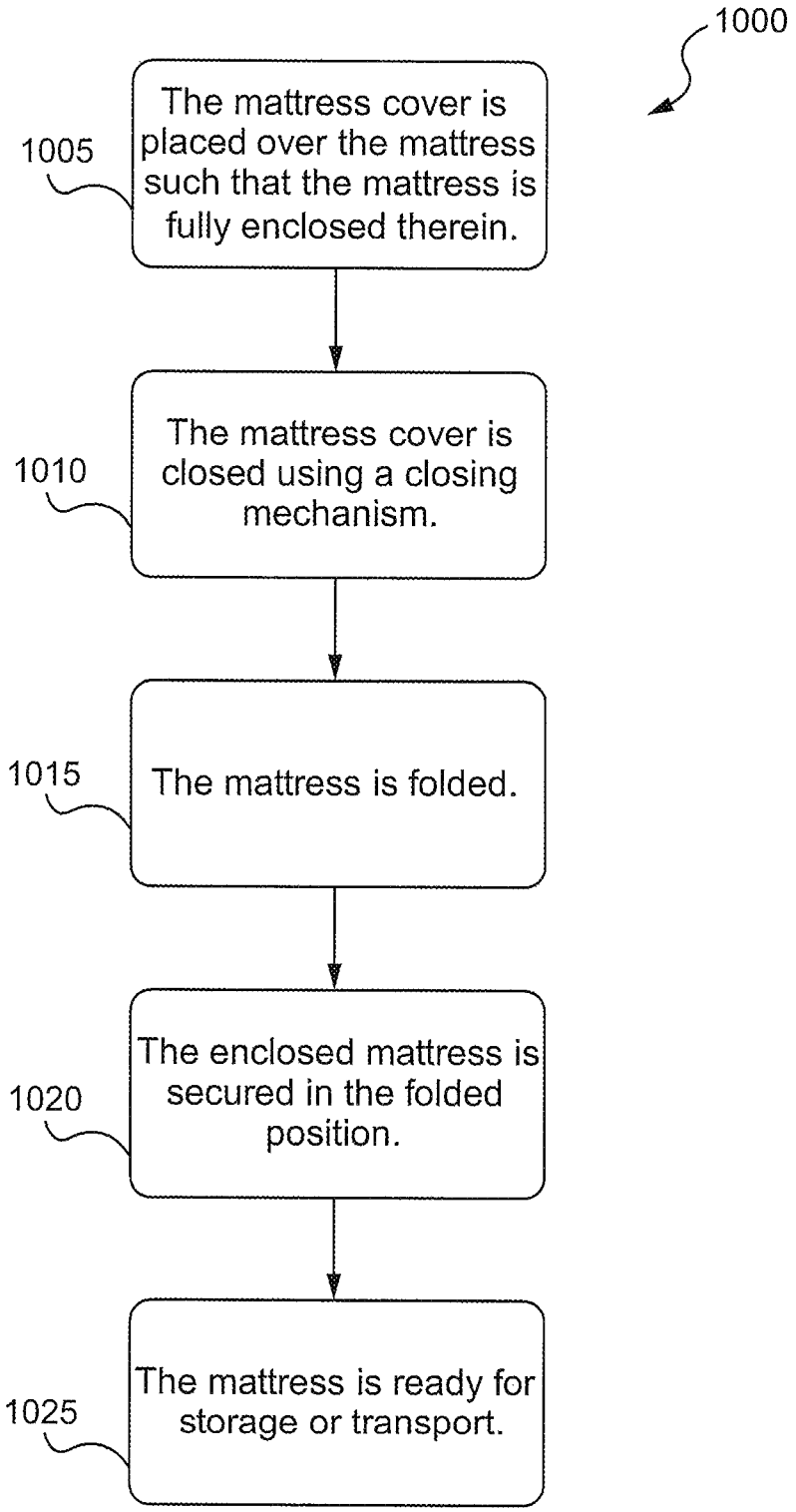
FIG. 10 shows a flowchart of an example method of use of a mattress carrier, in accordance with aspects of the present disclosure.

FIGS. 4-8 show views of various activities in an example step by step process for use of the mattress carrier to encapsulate a mattress, in accordance with aspects of the present disclosure. FIG. 10 shows a flowchart of an example method of use of a mattress cover, such as the mattress cover shown and described in FIGS. 4-8. In a first step, as shown in FIG. 4, the mattress cover 1 may be placed about the mattress 9, and when completed, the mattress 9 covered by the cover 1 may appear as shown FIG. 5. The straps 2A, 2B and handles 3 may be arranged all on one side, and the buckles may be disengaged when the cover 1 is placed over the mattress. The next step is to zip or otherwise close the end of the cover 1 while the cover 1 encapsulates the mattress. The mattress within the cover 1 may be oriented such that the section of the cover 1 without straps 2A, 2B may thereby be prepared for folding within the interior of the folded mattress and cover 1, as shown in FIG. 7, for example.

Figure 6:
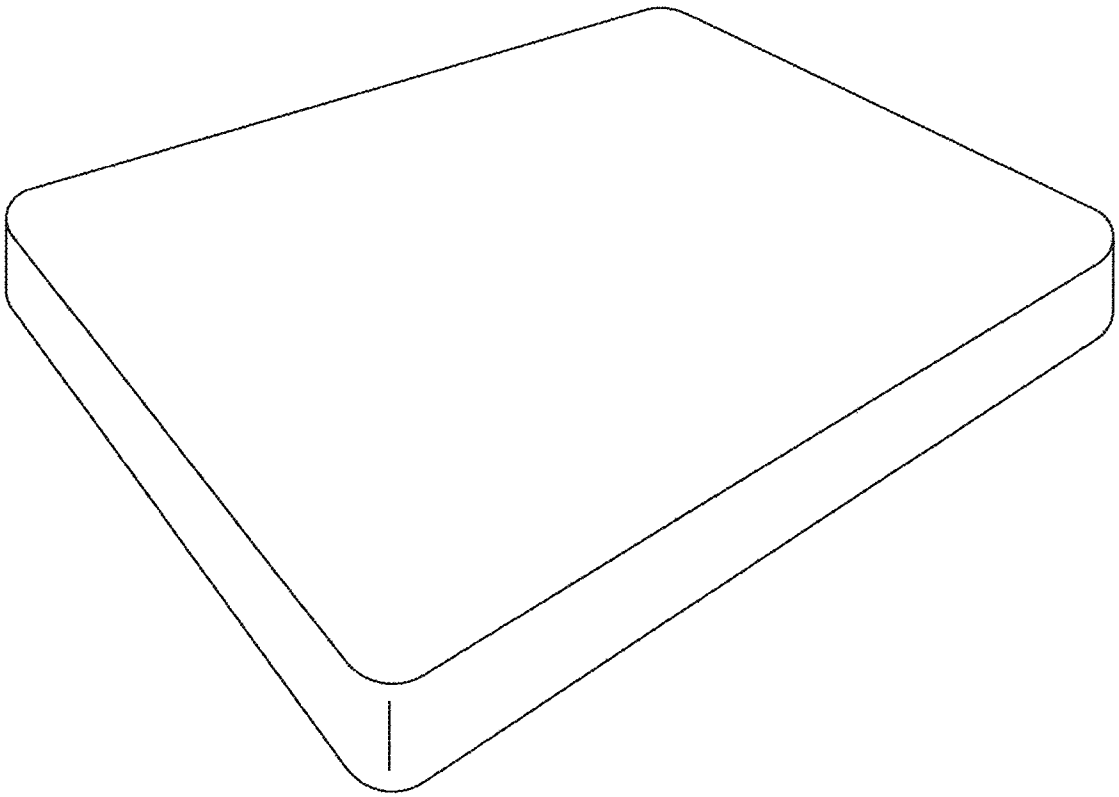
FIG. 6 shows a view of the mattress of FIG. 1 after being enclosed using the zipper, just before it is folded into the carrier form.
Figure 8:
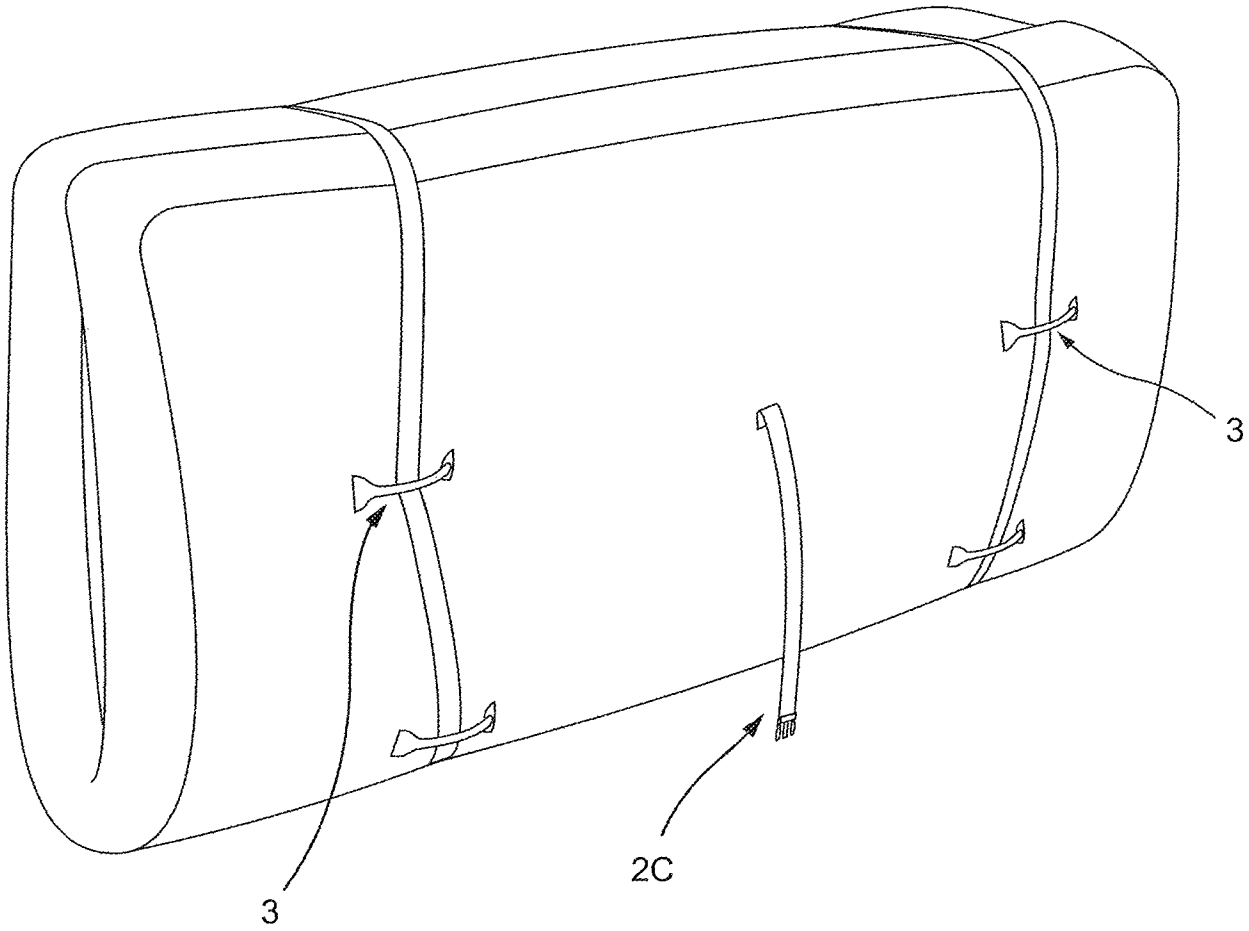
FIG. 8 shows a view of the mattress of FIG. 1 after the carrier has been fully set up and is in process of being transported.

FIG. 7 shows the mattress within the cover 1 of FIG. 6 being folded and secured into the carrier position. The cover 1 containing the folded mattress may be buckled via straps 2A, 2B at the location where the two ends 6 of the mattress meet after folding. As shown in FIG. 8, a support strap 2C may also be used (note that support strap 2C is shown hanging in an unattached position in FIG. 8). This support strap 2C may optionally be engaged for extra support, for example, if the mattress is more difficult to fold or hold together. The support strap 2C may be pulled, for example, in order to shorten any distance that remains between the ends of the enclosed mattress and to thereby minimize the width of the overall carrier when in use. A view of the example carrier for use with an encapsulated mattress is shown in FIG. 8. In FIG. 8, the handles 3 most convenient relative to the edge of the mattress may be used to lift the mattress carrier, for example. Note that handles oriented on the opposite side to shown in FIG. 8 may similarly be used during transport.

Figure 9:
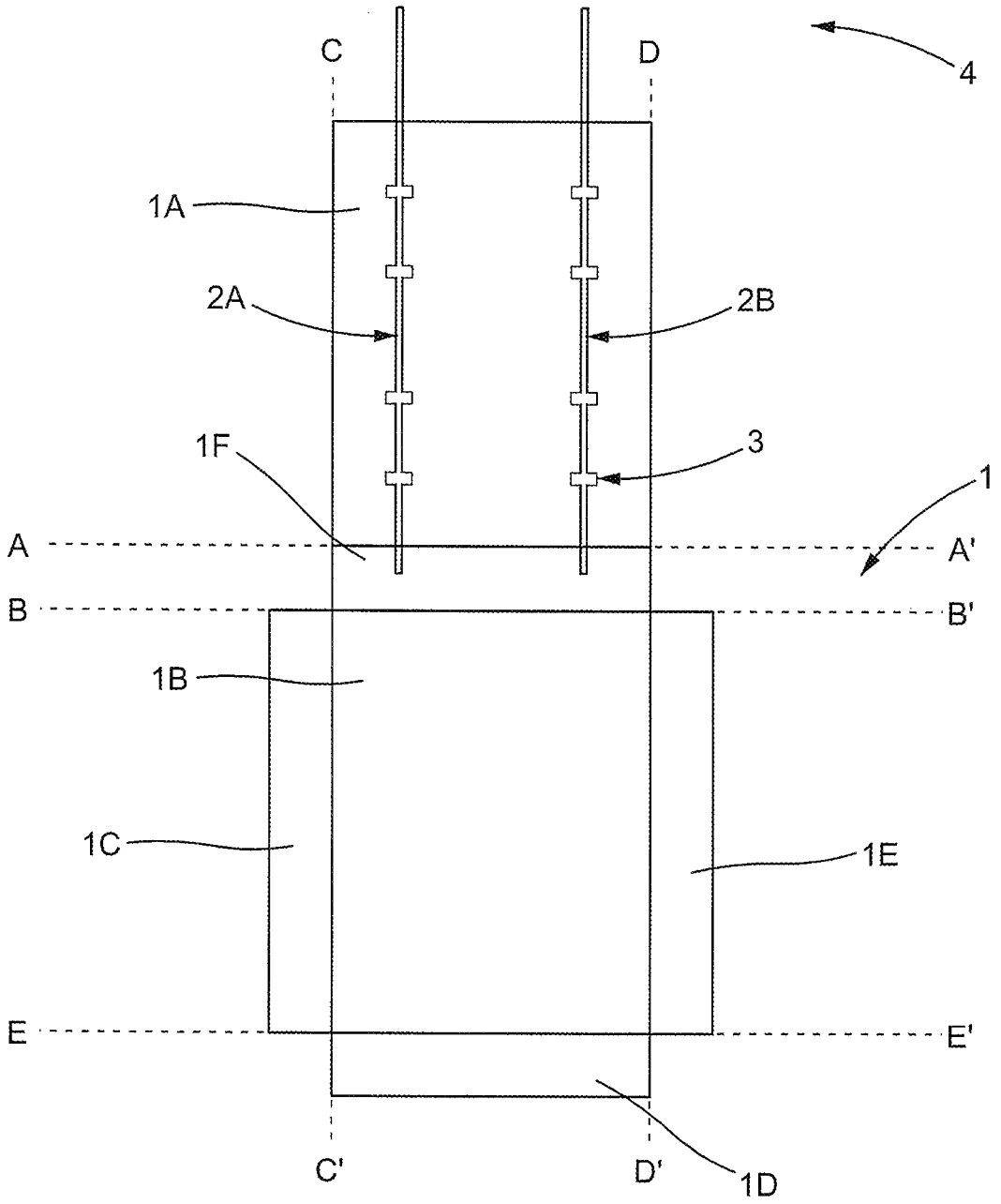
FIG. 9 shows a layout of a pattern, for manufacturing an example mattress cover with representative lengths of different parts of the cover illustrated for, one example mattress size, in accordance with, aspects of the present disclosure.
Figure 11:
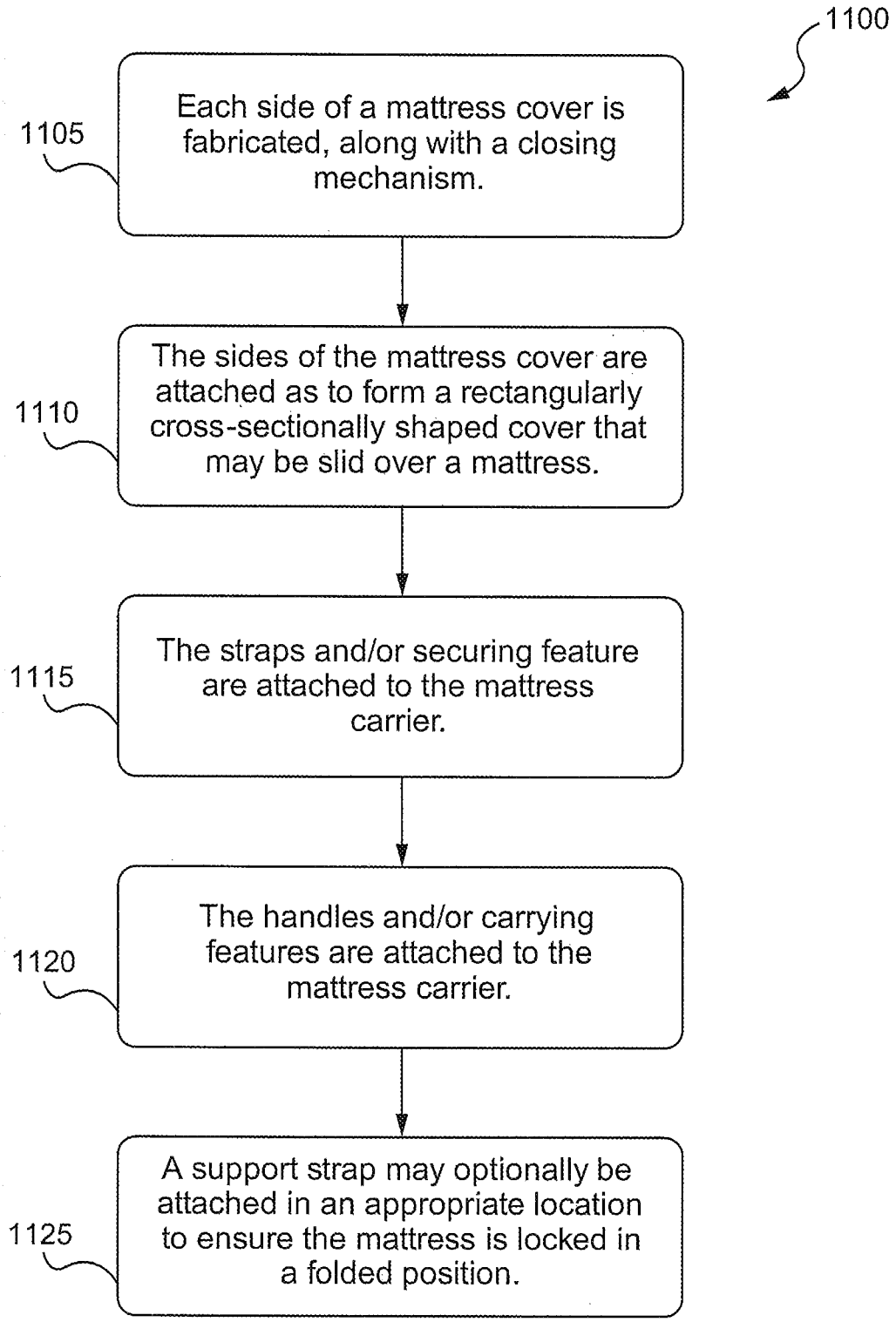
FIG. 11 shows a flowchart of an example method of manufacture of a mattress carrier, in accordance with aspects of the present disclosure.

FIG. 9 shows a full section view of an example pattern for manufacturing a mattress cover, prior to being sewn together or otherwise formed into an enclosable cover as shown in FIGS. 1-8. FIG. 11 shows a flowchart for an example method for assembling the mattress carrier, such as using the example pattern for the embodiment shown in FIG. 9. As shown in FIG. 9, the mattress cover 1 may include six body sections 1A-1F. Two of the sections 1A, 1B cover the faces of the mattress, which are the two largest sections of the mattress cover 1, and the other four sections 1C-1F cover the edges of the enclosed mattress. For this embodiment each of the six sections 1A-1F is rectangular in cross-sectional shape.

FIG. 9 also shows the dimensions of one example embodiment of a pattern for forming a mattress cover 1 suitable for use with a mattress of similar (or less) cross-sectional area than the area of face sections 1A, 1B and having a mattress thickness of the width (or less) of sections 1C-1F. The maximum length of an example mattress enclosable in the cover of FIG. 9 after being formed into the carrier arrangement (e.g., as shown in FIGS. 1-8) is therefore approximately 80 inches, the maximum width is approximately 60 inches, and the maximum thickness is approximately 12 inches. These dimensions, for example, could apply to a queen sized mattress. Other dimensions could apply for other sized mattresses, such as king, double, and twin sized mattresses. The straps 2A, 2B shown in FIG. 9 may be approximately 107 inches (or greater) in length, with approximately 22 inches extending from one end of section 1A and approximately 5 inches extending from the opposite end of section 1A, so as to allow the straps 2A, 2B to extend about the assembled cover 1 with an enclosed mattress to thereby secure the mattress within the cover 1. These strap lengths thereby also allow their two ends to be connected and to maintain the enclosed mattress in a folded position.

In manufacturing the cover for use, the mattress carrier may be formed using the pattern layout of the cover 1 of FIG. 9. To manufacture the cover from the pattern layout of the cover 1 into a form usable for transport and storage, for example, first face 1A may be folded along axis A-A' with side 1F, and side 1F may also be folded about axis B-B'. Sides 1C, 1E of the pattern layout of the cover 1 may be folded along respective axes C-C', D-D' and then connected (e.g., by sewing) to the edges of the folded face 1A along their edges opposite the folds along axes C-C', D-D'. Side 1D may then be folded along axis E-E' and attached along its edge opposite the fold along axis E-E' to the edge of side 1A that is opposite the fold along axis A-A'. These actions, when completed, create the formed cover for a mattress that may then be used as discussed above with respect to FIGS. 1-8.

A method of use of an example mattress carrier in accordance with, aspects of the present disclosure will now be described with reference to the flowchart 1000 shown in FIG. 10. In 1005, the mattress cover is placed over the mattress such that the mattress is enclosed therein. Further, for example, the cover may be oriented such that straps and handles may be arranged on one side. An example of various aspects of this step applied to an example mattress carrier may be seen in FIGS. 4 and 5, where a mattress is shown in process of being placed into the carrier.

In 1010, the mattress cover is closed using a closing mechanism. For example the mattress cover may be at one end of the cover using a closing mechanism, so the cover may be oriented such that the section of the cover is prepared for folding.

In 1015, the mattress is folded. For example, the mattress may be folded such that the straps on either end of the mattress carrier are next to each other, and each side has handles facing outward. An example of various aspects of this step applied to an example mattress cover may, be seen in FIG. 7, where a mattress is being folded into a position wherein the buckles on either end are oriented toward each other.

In 1020, the enclosed and folded mattress is secured. For example, the straps on either side, and the support strap, if used, may be buckled, so as to maintain the mattress in the folded position. An example of various aspects of this step applied to an example mattress cover is shown in FIG. 8, where a mattress is shown in the process of being buckled and the support strap 2C remains unused.

In 1025, the enclosed, folded, and secured mattress ready for storage and/or transport. For example, the enclosed, folded and secured mattress may be picked up by the handles on either side and transported to a desired location, along the lines as shown FIG. 8.

A method of making an example mattress carrier in accordance with aspects of the present disclosure will now be described with reference to the flowchart shown in FIG. 11. In 1105 each side of a mattress cover is fabricated, along with a closing mechanism. For example, the mattress carrier may have a closing mechanism built in, along with the straps, buckles, and the handles.

In 1110, the sides of the mattress cover are attached to form a rectangularly cross-sectionally shaped cover that may be slid over a mattress. An example of various aspects of this step applied to an example mattress cover is shown in FIG. 9. The sides may be attached as shown in FIG. 9, for example, and further attached on the remaining sides so as to form a rectangularly cross-sectionally shaped cover, with an opening along the edge where the closing mechanism is located.

In 1115, the straps and/or other securing features may be attached to the mattress carrier. For example, such features may be attached to the large face of the mattress, carrier such that they extend past the edge of the carrier on one side and may be attached to the corresponding features on an opposite face. An example of various aspects of this step applied to an example mattress cover is shown in FIG. 9, where the straps extend past the edge of the large side of the carrier and attach to corresponding features on an opposite side.

In 1120, the handles and/or any other carrying features may be attached to the mattress carrier. For example, such features may be attached to the same faces as the straps, such as with two or more handles on each side, so that the mattress may be transported using handles on both sides. An example of of various aspects of this step applied to an example mattress cover is shown in FIG. 9.

In 2025, a support strap may optionally be attached in an appropriate location to ensure the mattress is maintained in a folded position. For example, a support strap 2C is shown as so attached in FIGS. 1-5 and 8. In the example embodiment shown in FIGS. 1-5 and 8, the support strap is located between the other two straps and the handles, but the support strap may also be located in another location based on the needs of the particular implementation.

While the aspects described herein have been described in conjunction with the example aspects outlined above, various alternatives, modifications, variations, improvements, and/or substantial equivalents, whether known or that are or may be presently unforeseen, may become apparent, to those having at least ordinary skill in the art. Accordingly, the example aspects, as set forth above, are intended to be illustrative, not limiting. Various changes may be made without departing from the spirit and scope of the disclosure. Therefore, the disclosure is intended to embrace all known or later-developed alternatives, modifications, variations, improvements, and/or substantial equivalents.

Thus, the claims are not intended to be limited to the aspects shown herein, but are to be accorded the full scope consistent with the language of the claims, wherein reference to an element in the singular is not intended to mean "one and only one" unless specifically so stated, but rather "one or more." All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed as a means plus function unless the element is expressly recited using the phrase "means for."

It is understood that the specific order or hierarchy of the processes/flowcharts disclosed is an illustration of example approaches. Based upon design preferences, it is understood that the specific order or hierarchy in the processes/flowcharts may be rearranged. Further, some features/steps may be combined or omitted. The accompanying method claims present elements of the various features/steps in a sample order, and are not meant to be limited to the specific order or hierarchy presented.

Further, the word "example" is used herein to mean "serving as an example, instance, or illustration." Any aspect described herein as "example" is not necessarily to be construed as preferred or advantageous over other aspects. Unless specifically stated otherwise, the term "some" refers to one or more. Combinations such as "at least one of A, B, or C," "at least one of A, B, and C," and "A, B, C, or any combination thereof" include any combination of A, B, and/or C, and may include multiples of A, multiples of B, or multiples of C. Specifically, combinations such as "at least one of A, B, or C," "at least one of A, B, and C," and "A, B, C, or any combination thereof" may be A only, B only, C only, A and B, A and C, B and C, or A and B and C, where any such combinations may contain one or more member or members of A, B, or C. Nothing disclosed herein is intended to be dedicated to the public regardless of whether such disclosure is explicitly recited in the claims.

KEY

1 Mattress Cover
1A Mattress Cover Face

1B Mattress Cover Face
1C Mattress Edge Cover
1D Mattress Edge Cover
1E Mattress Edge Cover
1F Mattress Edge Cover
2A/B Straps
2C Support Strap
3 Handle
4 Buckle
5A/B Zipper
6 End of Mattress
9 Mattress

The invention claimed is:

1. A selectively removable mattress cover, comprising:
a covering material having an opening;
a closure device for selectively closing the opening in the covering material;
a strap securably extendable over ends of the mattress cover when the cover and a mattress received within the cover are in a folded position; and
at least one handle attached to the covering material for carrying a mattress received within the cover, wherein the at least one handle defines a loop that extends within a boundary defined by a top or bottom side of the cover, in the folded position, to which the at least one handle is attached, and wherein the strap extends along a longitudinal axis of the mattress cover and
the at least one handle extends along an axis normal to the longitudinal axis of the strap and wherein the strap extends between the mattress cover and the loop of the at least one handle.

2. The cover of claim 1, wherein the covering material comprises a durable, water-impermeable fabric.

3. The cover of claim 1, wherein the closure device comprises one selected from a group consisting of a zipper, at least one button or buckle, at least one hook and loop pair, a hook, a second strap, an end tie, and an envelope opening.

4. The cover of claim 1, further comprising:
a buckle or locking mechanism to allow one end of the strap to connect to the other end.

5. The cover of claim 1, wherein the strap includes a first end securable to a second end, and wherein the first strap end is proximal to a first end of the mattress cover and the second strap end is proximal to a second end of the mattress cover.

6. The cover of claim 5, wherein the at least one handle includes a first handle proximal to the first strap end and a second handle proximal to the second strap end.

7. The cover of claim 1, wherein at least one of the at least one strap is fastened to the mattress cover on one side, each of the fastened at least one strap extending from a first end of the mattress cover to an opposing second end of the mattress cover.

8. The cover of claim 1, wherein each of the at least one strap has a pair of ends, a first end extending along a first side of the cover in the folded position and a second end extending along a second side of the cover in the folded position.

9. The cover of claim 1, further comprising:
a support strap having a first strap portion and a second strap portion, the first strap portion being attached at a first point proximal to a centerline of the mattress cover, and being extendable from a first end of the mattress cover, and the second support strap being attached at a second point proximal to the centerline of the mattress cover, and being extendable from the second end of the mattress cover;
wherein the first strap portion and the second strap portion are connectable via a buckle when the mattress cover is in the folded position.

10. A method of using a mattress cover, the method comprising:
enclosing the mattress cover over the mattress;
folding and securing the mattress and the enclosing mattress cover; and
securably extending a strap over ends of the mattress cover when the cover and a mattress received within the cover are in a folded position; and
transporting the mattress via at least one handle, wherein the at least one handle defines a loop that extends within a boundary defined by a top or bottom side of the cover, in the folded position, to which the at least one handle is attached, and wherein the strap extends along a longitudinal axis of the mattress cover and the handle extends along an axis normal to the longitudinal axis of the strap and wherein the strap extends between the mattress cover and the loop of the at least one handle, while the mattress and the enclosing mattress cover are folded and secured.

11. The method of claim 10, wherein enclosing the mattress cover over the mattress further comprises:
fully encasing the mattress with the mattress cover such that the strap and each of the at least one handle are positioned on one side.

12. The method of claim 10, wherein folding and securing the mattress and the enclosing mattress cover further comprises:
engaging a buckle or locking mechanism to maintain the mattress in the folded position.

13. A method of making a mattress cover, the method comprising:
fabricating each component of the mattress cover;
attaching each components of the mattress cover to one another such that an opening for receiving a mattress is formed in the mattress cover;
attaching at least one securing feature to maintain the mattress within the cover; and
attaching at least one handle and at least one support strap to the mattress cover, wherein the at least one support strap is securably extendable over ends of the mattress cover when the cover and a mattress received within the cover are in a folded position, wherein the at least one handle defines a loop that extends within a boundary defined by a top or bottom side of the cover, in the folded position, to which the at least one handle is attached, and wherein the at least one strap extends along a longitudinal axis of the mattress cover and the at least one handle extends along an axis normal to the longitudinal axis of the strap and wherein the strap extends between the mattress cover and the loop of the at least one handle.

14. The method of claim 13, wherein fabricating each component of the mattress cover further comprises:
fabricating each of the six sides of the cover;
incorporating a closing mechanism; and
fabricating at least one of the at least one support strap, a buckle, or the at least one handle.

15. The method of claim 14, wherein attaching the components of the mattress cover to one another such that an opening for receiving a mattress is formed in the mattress cover further comprises:

attaching at least two sides of the mattress cover to one another to form a rectangularly cross-sectionally shaped mattress cover having a plurality of faces and a plurality of edges;

wherein each of the at least one support strap is attached to one of the plurality of faces of the mattress cover, and wherein each of the at least one attached support strap is extendable past at least one of the plurality of edges of the mattress carrier for attachment to at least a second one of the plurality of faces of the mattress cover.

* * * * *